United States Patent [19]

Zildjian

[11] 4,248,129

[45] Feb. 3, 1981

[54] HI HAT CYMBAL

[75] Inventor: Robert Zildjian, Meductic, Canada

[73] Assignee: Avedis Zildjian Company, Accord, Mass.

[21] Appl. No.: 7,891

[22] Filed: Jan. 31, 1979

[51] Int. Cl.[3] ..... G10D 13/06

[52] U.S. Cl. ..... 84/422 R; 84/402

[58] Field of Search ..... 84/422 R, 402, 421

[56] References Cited

U.S. PATENT DOCUMENTS

| | | | |
|---|---|---|---|
| 3,118,339 | 1/1964 | Hoellerich | 84/421 |
| 3,185,014 | 5/1965 | Ross | 84/422 |
| 3,499,361 | 3/1970 | Harleman | 84/402 |
| 3,546,994 | 12/1970 | Paiste | 84/422 X |
| 4,114,502 | 9/1978 | Zildjian | 84/402 |

*Primary Examiner*—J. V. Truhe
*Assistant Examiner*—Shelley Wade
*Attorney, Agent, or Firm*—Kenway & Jenney

[57] ABSTRACT

On a Hi Hat cymbal stand the upper cymbal is one of conventional design and the lower cymbal is a cupless cymbal with four small air release holes through its central portion, each hole being about ½ inch in diameter.

2 Claims, 3 Drawing Figures

HI HAT CYMBAL

BACKGROUND OF THE INVENTION

This invention relates to Hi Hat cymbal arrangements and more particularly to a specially constructed lower cymbal for such an arrangement.

One of the usual ways of clashing two cymbals together without using the hands is the so-called Hi Hat arrangement. In this mechanical arrangement, two cymbals are loosely mounted at the top of a strand, where they are held apart from each other. The top cymbal may then be brought down on a rod sliding through the bottom cymbal to strike the cymbal on the bottom by operation of a foot pedal.

The usual Hi Hat cymbal arrangement has similar cymbals as both the top and bottom cymbals. There have been Hi Hat arrangements in which essentially only one cymbal, the upper one, gives off a sound, when it strikes a lower striking arrangement mounted on the stand. Such an arrangement is illustrated, for example, in U.S. Pat. No. 3,185,014, where a skeletal anvil replaces the lower cymbal to provide an economical substitute. The patent includes a variation in which something more like an actual cymbal is used as the lower portion of the arrangement. But the lower cymbal in that case is shown to have large "openwork" openings, which would detract greatly from the strength of the cymbal, requiring the cymbal to be made, presumably, with some thickness or from some type of material not like that of the usual musical cymbal.

While useful for most purposes the conventional arrangement of a pair of cupped cymbals gives a particular sound that is not desirable for certain applications. If an immediate crisp dry and penetrating sound is desired such a conventional Hi Hat cymbal arrangement will not achieve it. Accordingly, it is an object of the invention to provide a configuration of cymbals in a Hi Hat arrangement that will produce an immediate, crisp, dry, and penetrating sound.

It is another object of the invention to provide such an arrangement of cymbals that can be used with existing Hi Hat support structures.

It is another object of the invention to provide an arrangement of Hi Hat cymbals that produce a particular desired sound and do not depart significantly from existing cymbal structure so that they can be manufactured with conventional cymbal manufacturing processes, and can be produced efficiently and inexpensively.

Other objects of the invention will in part be obvious and will in part appear hereinafter.

SUMMARY OF THE INVENTION

The invention comprises a cupless lower cymbal in a Hi Hat cymbal arrangement in which the lower cymbal rests firmly at its center on the Hi Hat support, the lower cymbal having a plurality of circumferentially spaced small holes in the central portion of the cymbal for the release of air.

BRIEF DESCRIPTION OF THE DRAWING

For a fuller understanding of the nature and objects of the invention, reference should be made to the following detailed description and the accompanying drawings in which.

DESCRIPTION OF A PREFERRED EMBODIMENT

Figure 1:
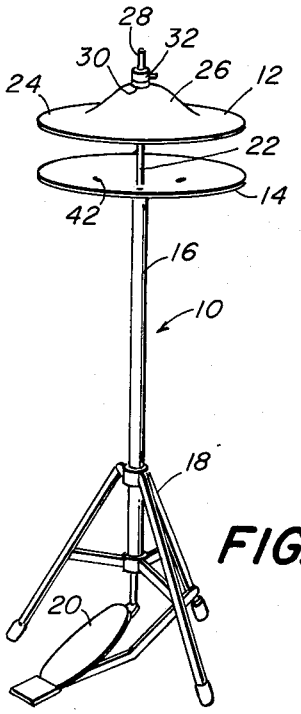
FIG. 1 is a perspective view of cymbals embodying the invention, arranged on a Hi Hat stand.
Figure 2:
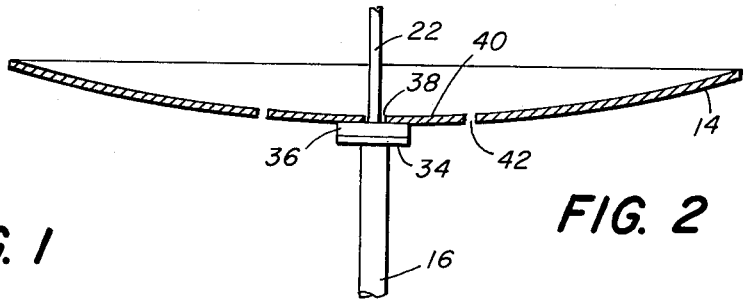
FIG. 2 is an elevation view of a portion of the upper part of the stand, showing the lower cymbal in cross section.

Referring to FIGS. 1 and 2, there is shown a conventional Hi Hat cymbal support structure 10, an upper cymbal 12, and a lower cymbal 14. The support structure 10 is arranged of components well known to those familiar with the industry. It includes a cylindrical rod 16 supported on a tripod base 18. A foot pedal 20 at the bottom of the structure operates a vertically movable cymbal rod 22 that is slidable within the cylinder 16.

The upper cymbal 12 and the method of its connection to the support structure 10 are also conventional. The upper cymbal 12 is of the usual shape, namely, it has a peripheral portion 24 and a central dome or cup 26. It also has a central hole through which the upper end 28 of the cymbal rod 22 extends. Though not shown in the drawings, there is a collar on rod 22 that supports a felt disk on which the upper cymbal 12 rests. Above the cymbal 12 a felt disk 30 overlies the cymbal; above the felt disk there is a nut 32 screwed on the upper end 28 of the cymbal rod 22 to prevent escape of the cymbal from the rod. The nut 32 is free of clamping engagement with the felt disk 30, and the upper cymbal's hole is larger than the diameter of the rod 22, so that the cymbal 12 is loosely held and is free to tilt and vibrate on the rod 22.

Figure 3:
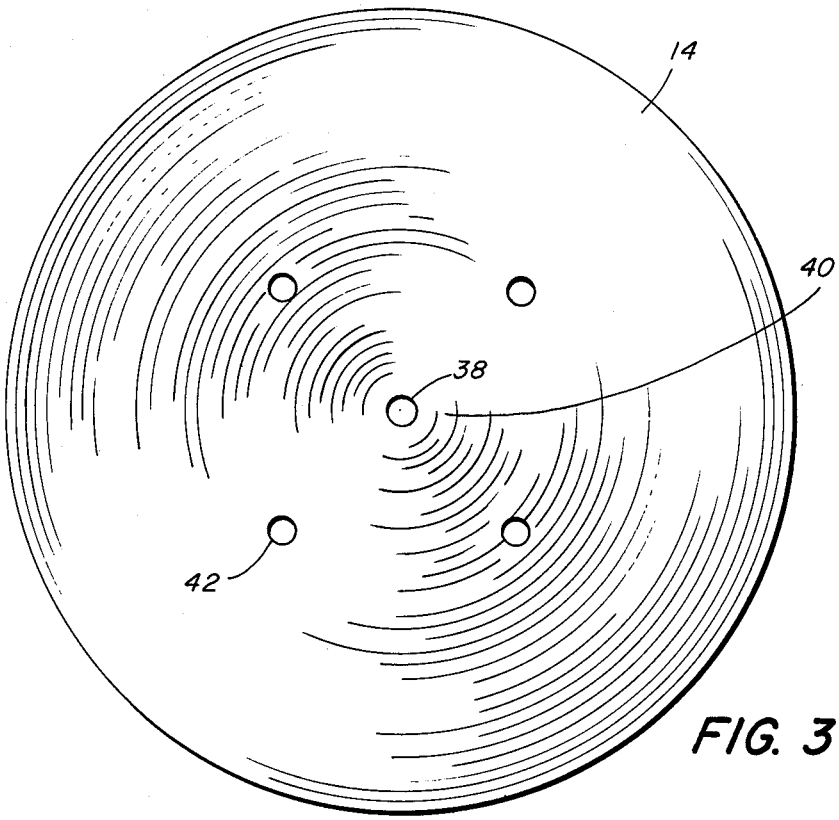
FIG. 3 is a plan view of the lower cymbal.

Referring to FIGS. 2 and 3, there is shown in detail the bottom cymbal 14 and its arrangement on the support structure 10. Cylinder 16 has a flat collar 34 on which rests a flat felt disk 36. The lower cymbal 14 has a central hole 38 through which the upper cymbal rod 22 loosely passes. The cymbal 14 therefore rests on the flat felt disk 36. The central hole 38 of the lower cymbal 14 is larger than the diameter of the rod 22, and since there is nothing above the lower cymbal 14 to hold it, it is free to tilt and vibrate when struck. The bottom cymbal 14 does not have, however, the conventional shape of the upper cymbal 12, in that is has no cup portion. Without a central cup portion, the cymbal 14 has in cross section (as shown in FIG. 2) a generally lens-like shape which is almost flat at the cymbal's central portion 40. Accordingly, while it is free to tilt and vibrate when struck, the firm contact that the almost flat central area 40 of the lower cymbal 14 makes with the conventional flat felt disk 36 resuls in very little wobble by the lower cymbal when it is struck. Furthermore, the lower cymbal 14 has, as illustrated best in FIG. 3, four air release holes 42 besides the central hole 38. Each of these four holes 42 is relatively small, about ½ inch in diameter, and is drilled completely through the cymbal 14. The holes 42 are each about 3 inches from the center of the cymbal and equally circumferentially spaced apart.

In operation of this Hi Hat cymbal arrangement, the foot pedal 20 is pressed with the foot, and the upper cymbal 12 is brought down onto the lower cymbal 14. When a lower cymbal like that described in the embodiment is used a sound unlike that associated with conventional Hi Hat cymbal arrangements is achieved. The relatively flat surface of the cymbal's central portion 40, due to the absence of a cup and the shallow curvature of the cymbal leads to the result that the cymbal 14, while loosely held, is nevertheless firmly seated on the felt disk 36 of the support structure 10. The firmness of the lower cymbal 14 in its position when it is struck by the upper cymbal creates a very special immediate, crisp, dry, and penetrating sound.

Many of the normal overtones of a cup cymbal are eliminated by the elimination of the cup and by the firm resting of the bottom cymbal of a hi-hat stand. The achievement of this special sound is obtained purely by manipulation of the foot pedal. It is not required that the operator of the cymbals, typically the drummer, need a combination of foot and stick or hand to achieve this desired sound.

The holes 42 in the lower cymbal 14 allow air trapped between the cymbals to be released during operation of the cymbal. The wobbling of the conventional lower cymbal in a Hi Hat arrangement not only contributes to overtones eliminated in this arrangement but also allows trapped air to escape. The holes 42 then are particularly necessary because the lower cymbal 14 does not wobble when struck.

Holes are generally undesirable in cymbals because of the fragile structural strength of cymbals. Locating the holes relatively close to the center of the lower cymbal 14, in the embodiment less than one-half of the radius of the cymbal, permits the structural integrity of the cymbal to be maintained. Holes further out from the center and closer to the periphery of the cymbal would have a deleterious effect on the strength of the cymbal.

Similarly, holes larger than ½ inch in diameter would also weaken the structural integrity of the cymbal, so that in the embodiment shown, which represents a 14 inch diameter cymbal, a typical size, the use of four equally spaced apart holes of a ½ inch in diameter, each less than ½ of the way out from the center hole probably represents the maximum size and distance from the center that should be used. The holes 42 are equally circumferentially spaced apart and are located equal distances from the center of the cymbal to balance the forces resulting from the release of air through them during operation of the cymbal.

While some modification and rearrangement of the holes may be possible, the general parameters allow the use of a lower cymbal of the desired shape to be used on a conventional Hi Hat stand, to achieve sounds not normally available with such arrangements.

What I claim as my invention is the following:

1. For use with a Hi Hat cymbal arrangement including means for loosely supporting a lower cymbal so as to permit rocking movement including a flat collar means mounted on a support rod, and means for loosely supporting an lower cymbal above said upper cymbal, responsive to a control means so that said upper cymbal may be brought down to meet said lower cymbal by operation of said control means, and an upper cymbal having a central cup portion:

a substantially lens-shaped lower cymbal having a central opening substantially larger than said support rod to permit said rocking movement and, a substantially flat central portion for resting firmly on said flat collar means when struck by said upper cymbal during operation of said cymbal arrangement, said lower cymbal defining a plurality of circumferential spaced substantially small holes through said cymbal for the release of air trapped between said cymbals during operation of said cymbal arrangement, said holes being located equal distances from the center of said lower cymbal, less than one-half the radius of said cymbal from said center.

2. The combination as claimed in claim 1 in which said holes are ½ inch or less in diameter.

* * * * *

UNITED STATES PATENT AND TRADEMARK OFFICE

CERTIFICATE OF CORRECTION

PATENT NO. : 4,248,129
DATED : February 3, 1981
INVENTOR(S) : Robert Zildjian

It is certified that error appears in the above-identified patent and that said Letters Patent are hereby corrected as shown below:

Col. 4 line 16 (Claim 1): "lower" should be --upper-- and "upper" should be --lower--.

Signed and Sealed this

*Twenty-third* Day of *June 1981*

[SEAL]

*Attest:*

RENE D. TEGTMEYER

*Attesting Officer*

*Acting Commissioner of Patents and Trademarks*